US005197735A

United States Patent [19]

Land et al.

[11] Patent Number: 5,197,735

[45] Date of Patent: Mar. 30, 1993

[54] GAME PIECE RANDOMIZER

[76] Inventors: Larry D. Land; Marie A. Land; Melissa L. Land, all of 1946 Edgerton, St. Paul, Minn. 55117

[21] Appl. No.: 715,844

[22] Filed: Jun. 14, 1991

Related U.S. Application Data

[63] Continuation-in-part of Ser. No. 477,551, Feb. 9, 1990, abandoned.

[51] Int. Cl.[5] ..... A63F 9/04

[52] U.S. Cl. ..... 273/138 R; 273/145 C; 273/450

[58] Field of Search ..... 273/145 R, 145 A, 145 B, 273/145 C, 145 CA, 145 D, 144 R, 144 A, 120 R, 126 R, 138 R, 440, 450, 459

[56] References Cited

U.S. PATENT DOCUMENTS

| | | | |
|---|---|---|---|
| 481,398 | 8/1892 | Goujon . | |
| 591,269 | 10/1897 | Dubois | 273/145 C |
| 982,747 | 1/1911 | Schultze | 273/145 E |
| 2,241,567 | 5/1941 | Wobensmith | 273/145 B |
| 2,452,730 | 11/1948 | Carter | 273/145 C |
| 2,746,757 | 5/1956 | Frost | 273/145 C |
| 3,350,098 | 10/1967 | Cromp et al. | 273/145 CA |
| 3,578,320 | 5/1971 | Goldfarb . | |
| 3,638,945 | 2/1972 | Breslow . | |
| 3,724,847 | 4/1973 | Compton . | |
| 3,761,091 | 9/1973 | Zohn | 273/145 E X |
| 3,771,790 | 11/1973 | Kong . | |
| 3,951,412 | 4/1976 | Adams | 273/145 B X |
| 4,087,090 | 5/1978 | Goldberg . | |
| 4,108,431 | 8/1978 | Camara . | |

FOREIGN PATENT DOCUMENTS

| | | | |
|---|---|---|---|
| 512790 | 7/1952 | Belgium | 273/145 E |
| 333145 | 4/1920 | Fed. Rep. of Germany | 273/145 B |
| 360356 | 8/1921 | Fed. Rep. of Germany | 273/145 A |
| 1033570 | 7/1958 | Fed. Rep. of Germany | 273/145 C |
| 2939802 | 4/1981 | Fed. Rep. of Germany | 273/145 C |
| 719503 | 2/1932 | France | 273/120 R |
| 2332777 | 6/1977 | France | 273/145 C |
| 2073600 | 10/1981 | United Kingdom | 273/138 R |

*Primary Examiner*—V. Millin
*Assistant Examiner*—Sebastiano Passaniti
*Attorney, Agent, or Firm*—Douglas L. Tschida

[57] ABSTRACT

Apparatus for randomly manipulating and distributing one or a plurality of game pieces such as dice, marbles, coins or the like. In one construction, the game piece is contained within a closed housing having a plurality of apertures formed through side and end walls to support selectively positioned obstruction pieces which may be positioned by the players in a random or predetermined pattern to provide a plurality of passageways through which the game pieces must pass. In another construction, an open ended housing includes a game piece receiving portion, a player selectable directing portion and a randomizer portion including a plurality of obstruction pieces. In another construction, one or more coins may be semipermanently contained within the housing. In still other constructions, the housing is constructed in halves, each of which contain integral obstruction pieces which define a plurality of passageways to a plurality of permanently contained game pieces.

11 Claims, 12 Drawing Sheets

GAME PIECE RANDOMIZER

This is a division of application Ser. No. 07/477,551, filed Feb. 9, 1990, now abandoned.

BACKGROUND OF THE INVENTION

The present invention relates to game piece manipulators and in particular to a user selectable randomizer.

Varieties of board games and games of chance are focused upon randomly manipulated game pieces, such as the spinning of a spinner relative to a numbered wheel, the throwing of dice or the manipulation of a marble relative to a valued game board compartment, as in roulette. Scoring is being determined in relation to the randomly manipulated game piece.

Applicant is aware that random movement of some game pieces can be facilitated with a mechanical appliance, such as with a dice cup or a rotatable dice cage. Devices of this type most typically contain the game piece within a housing having a generally unobstructed interior. Examples of some of such structures can be found in U.S. Pat. Nos. 3,360,267; 4,383,689; 4,826,170; 4,807,883; 4,805,908; 4,428,579; and 4,428,580. Movement of the surrounding housing determines the movement of the game piece.

Pinball machines and the like also depend upon a randomly manipulated game piece, although include obstructions which are rigidly secured to one surface of a game board to randomly direct the game piece, upon striking same. Ones of such games also include ledges positioned about the game board surface for catching the game piece. Such assemblies, however, provide for a fixed gameboard structure which does not permit user intervention relative to the positioning of the obstructions.

Appreciating, however, the greater variables of randomness which are introduceable by way of manipulators which permit user intervention and the further desirability of a holder for containing the game pieces, Applicant has developed a variety of constructions of randomizers which facilitate the foregoing ends.

SUMMARY OF THE INVENTION

It is accordingly a primary object of the present invention to provide a randomizer for confining one or more game pieces to a housing including obstruction pieces which are selectively mountable in the housing.

It is a further object of the invention to provide a housing including means for permitting arbitrary user placement of one or a plurality of the obstruction pieces.

It is a further object of the invention to provide housings of different configurations to accommodate varieties of game and obstruction pieces.

In variously described constructions of the invention, enclosed tubular and cubic housings provide a plurality of through apertures formed in the side and housing end walls to matingly receive obstruction pieces mountable within one or more of the apertures. The obstruction pieces extend partially or completely between opposite wall surfaces of the housing. One or more game pieces contained within the housings encounter the user positioned obstructions, much in the fashion of an obstacle course, upon manipulating the housings within a predetermined play pattern, for example alternately inverting and re-inverting the housing.

In another construction of the invention, a housing provides open upper and lower ends and intermediate of which are provided aperture containing sections wherethrough obstruction pieces are positionable in predetermined and/or random patterns. A game piece directing section of the housing otherwise includes a plurality of pseudo-randomly positioned apertures, wherethrough players can position or not other obstruction pieces. The game piece otherwise is admitted at a receiver section and exits through partitioned windows in the housing to a bottom tray, once the game piece has traversed the obstruction pieces.

The foregoing objects, advantages and distinctions of the invention, among others, as well as the details of the variously considered constructions will become more apparent hereinafter upon reference to the following description with respect to the appended drawings. Before referring thereto, it is to be appreciated the following description is made by way only of variously considered and presently preferred constructions. Such constructions should not be interpreted in limitation of the invention, but should be interpreted to encompass all those constructions contemplated by the following claims.

DESCRIPTION OF THE PREFERRED EMBODIMENT

Figure 1:
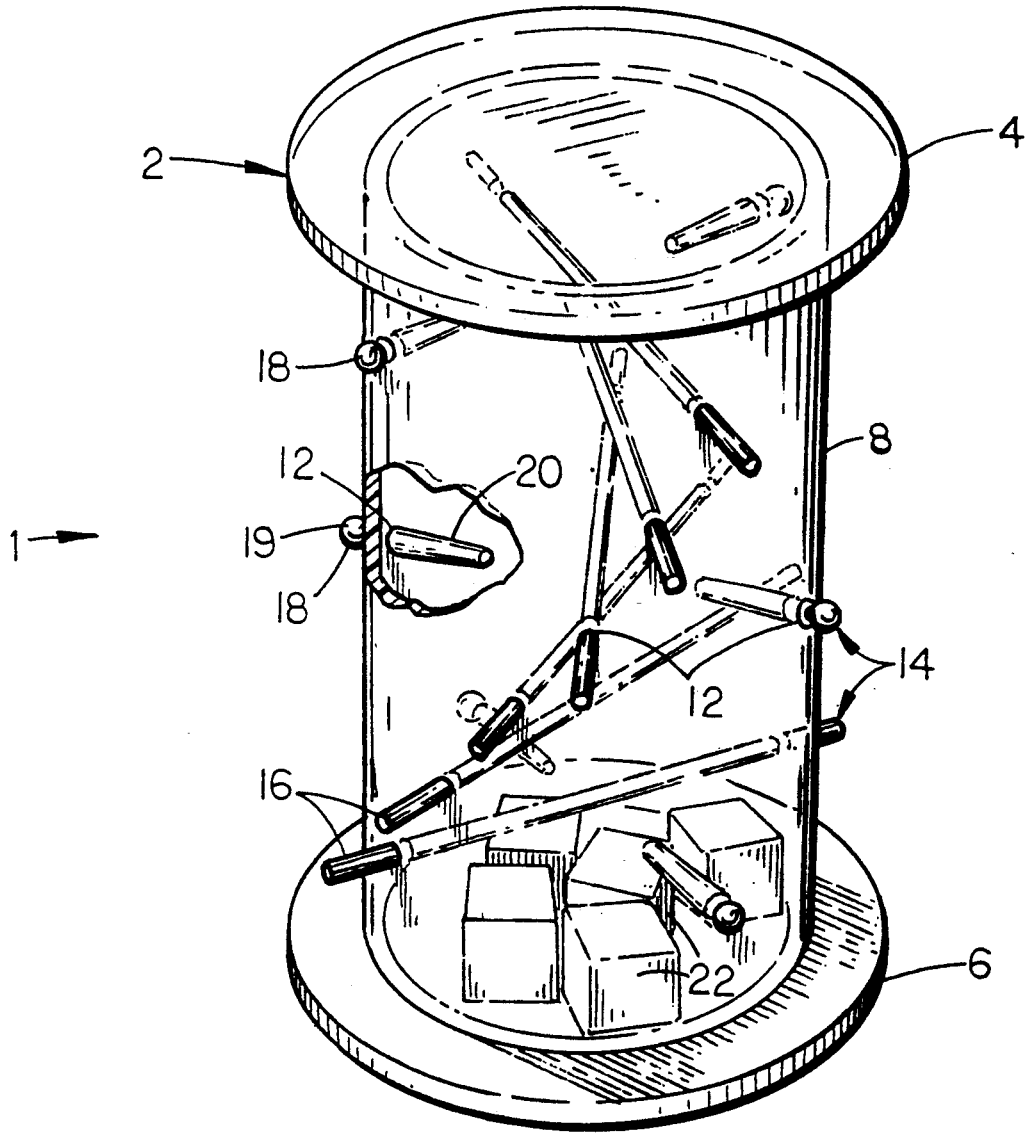
FIG. 1 shows an isometric drawing of a closed tubular, dice containing housing.

Referring to FIG. 1, an isometric drawing is shown of a game piece randomizer 1 having a tubular housing 2 including upper and lower, circularly flat endplates 4 and 6 which are bonded to a tubular mid-portion 8. As presently constructed, the housing 2 is formed of clear, acrylic materials which, through the selective use of various adhesion systems, permit permits the bonding of the walled portions 4, 6 and 8 of the housing to each other to form the depicted housing 2.

Figure 2:
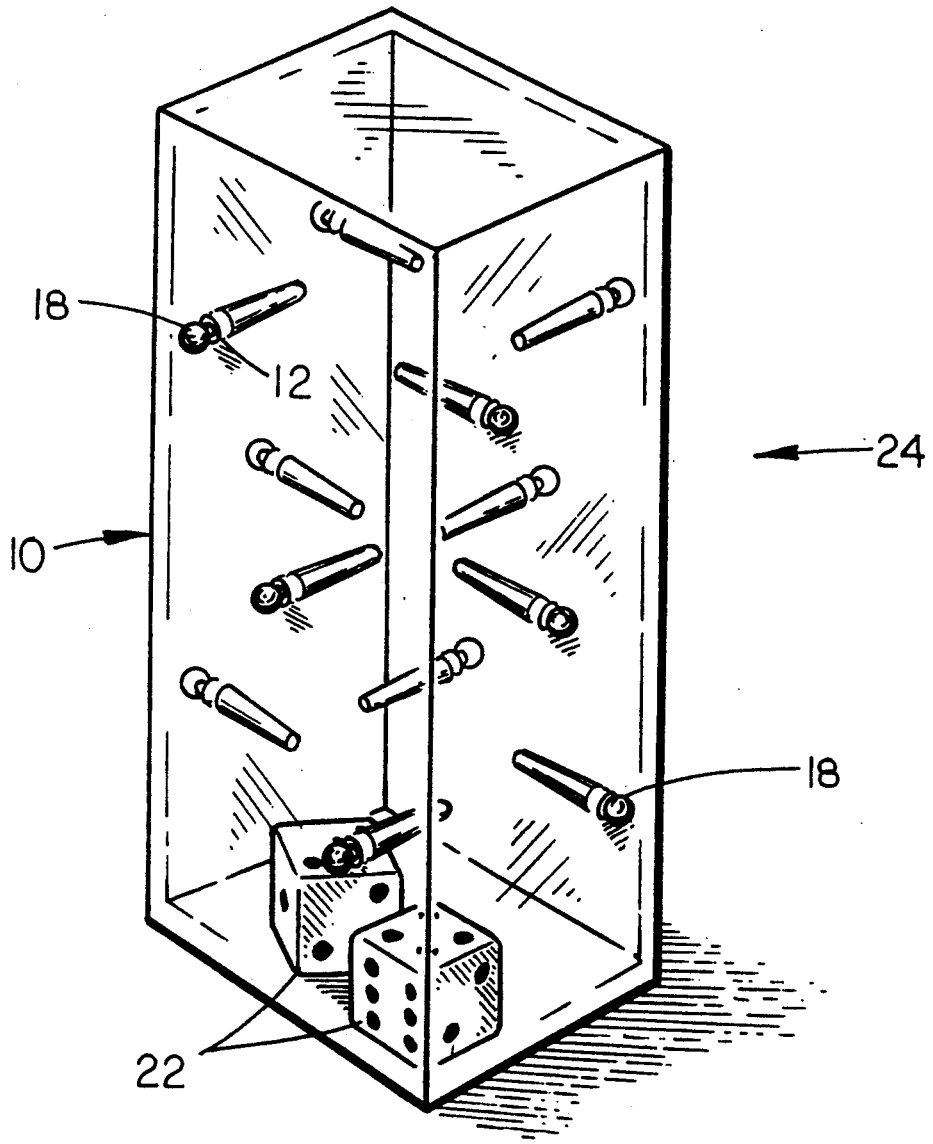
FIG. 2 shows an isometric drawing of a closed, rectangular or flat walled housing for shaking dice.

Although FIG. 1 shows a tubularly constructed housing and FIG. 2 depicts a rectangular housing 10, it is to be appreciated that still other multi-sided enclosed housing constructions can be formed, such as cubes, spheres, octagons or the like. The specific shape merely being a matter of manufacturer preference and/or imagination. The more elaborate the configuration, however, the greater the labor requirements to fit and bond the walls to one another.

Provided along the length of the tubular wall 8 are a plurality of through apertures 12 and wherein individual obstruction pieces 14 are mountable. These apertures may either be randomly distributed or may align with selected other apertures formed in opposite or adjacent walls. As depicted in FIG. 1, the apertures are formed through opposite sides of the tubular wall 8 to provide a spiral ladder work, upon inserting full length obstruction pieces 16 through the aligning apertures in the opposite side walls. That is, the obstruction pieces 16 comprise enlongated rods of a diameter comparable to the apertures which extend completely through the housing 2.

In contrast, the obstruction pieces 18, only partially extend into the interior of the housing 2. A ball-like head 19 and tapered body 20 are provided on the pieces 18 to facilitate insertion. Thus, a player has a great deal of alternate paths the game pieces can traverse. For the assembly 1, the game pieces comprise a plurality of permanently contained dice 22.

In contrast to FIG. 1, the assembly 24 of FIG. 2 discloses a construction wherein the obstruction pieces 18 extend only partially interiorly of the housing 10 from each of the side walls. These obstruction pieces 18, as mentioned, include a shaped end 19 and tapered body 20. As with the assembly 1, the obstruction pieces 18 are mountable at the user's discretion. The amount of jostling which the game pieces (i.e. dice 22) undergo as they fall within either of the housings 2 or 10, upon rotating same, and the pathways taken will depend upon the placement of the obstruction pieces 18.

Relative to obstruction piece placement, the principle concern is that too many obstruction pieces 14 not be used or else movement of the game pieces can become unduly hampered. Instead of performing the desired function of providing a random movement of each game piece, one or more game pieces can become lodged amongst the obstruction pieces 14. Appreciating also that the movement of the game pieces could become semi-predictable for a patterned positioning of the obstruction pieces 14, the present housing 2 and 10 allow players to change same over the course of time to provide different game piece actions and random pathways. Alternatively, however, the obstruction pieces 14 could be permanently bonded to the housings 2 and 10 by suitable adhesives or integrally formed therewith (reference FIGS. 5*a*, 5*b* 5*c* and 6).

In contrast to pinball machines and the like, it is to be appreciated the present obstruction pieces 14 merely cause a careening action which is of no consequence other than randomizing the game piece fall relative to all available pathways. It is only, the ultimate positioning of the game piece upon falling through a created random obstacle course, comprised of a plurality of the obstruction pieces 14, that determines the play event.

With the foregoing in mind, it is to be appreciated that still other closed or open housing constructions of various shapes and sizes can also be constructed. Such housings, as with the enclosed housings 2 and 10, can use dice or a variety of other game pieces, such as coins or marbles (reference FIGS. 3, 4, 5*a*–5*c* and 6). Mechanical actuators may also be included to facilitate manipulation of the game pieces relative to the obstruction pieces.

Figure 3:
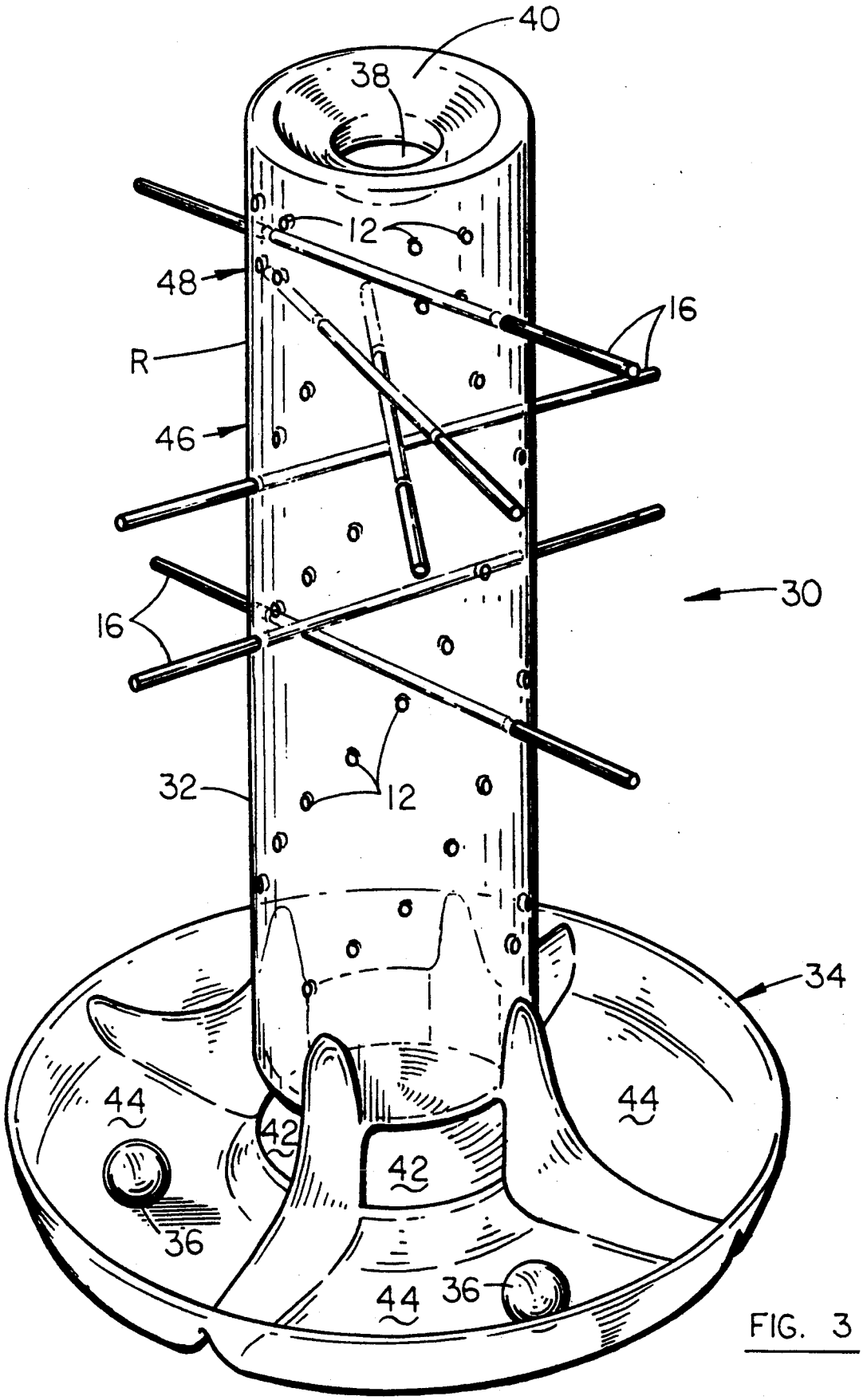
FIG. 3 shows an isometric drawing of an open-ended, cylindrical randomizer which provides for a player selectable section and a pre-patterned obstruction piece containing section, intermediate a game piece receiver and partitioned scoring compartment

In the latter regard, attention is directed to FIG. 3 wherein an assembly 30 is shown that provides a tubular housing 32 having a partitioned, saucer like tray bottom 34. The tray receives a plurality of marbles 36, upon dropping a number of marble game pieces through a receiver aperture 38 at the top of the housing 32. The receiver section of the housing 32 also includes a funnel-like forward section 40 which pre-directs the marbles and which is desirable if a number of marbles are placed in play simultaneously. As they progress through the housing 32, the marbles strike the obstruction pieces 16 and ultimately are randomly deflected to exit via one of a plurality of openings 42 within the housing sidewalls, to one of a number of co-aligned tray partitions 44.

In contrast to the assemblies 1 and 24 of FIGS. 1 and 2, the assembly 30 of FIG. 3 provides for an obstacle path which includes a patterned obstruction portion 46 lying beneath a reference line R and a player directing portion 48 lying above the reference line R. That is, the apertures 12 of the lower patterned portion 46 provide adjacent columns of obstruction pieces 16 which are mounted in spiral ladder fashion to each other. The apertures of upper portion 48 otherwise are randomly positioned, such that a player can mount one or more of a number of obstruction pieces 16 to vary or pre-direct the initial fall of the marble or marbles, before striking the lower patterned portion 48. Thus, where a player may become accustomed to the peculiarities of fall of a predetermined lower portion 48, the upper portion can be tailored to vary the fall, by merely repositioning one or more of the obstruction pieces 16.

Figure 4:
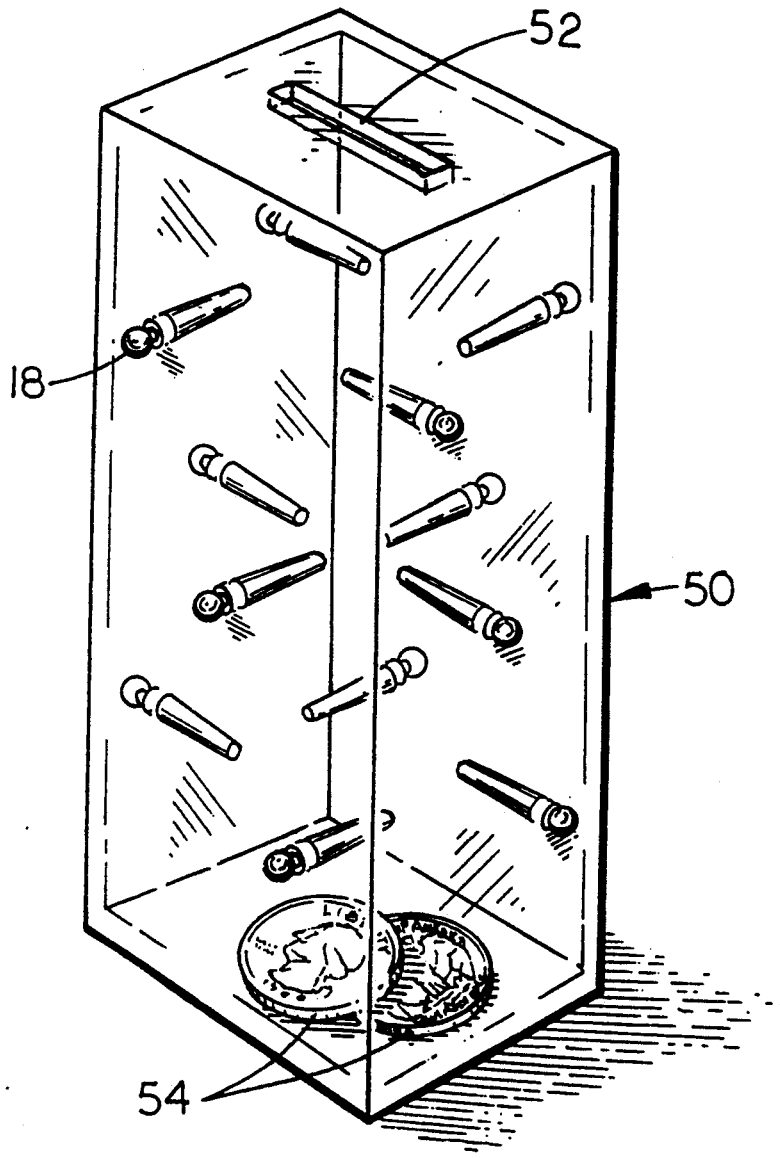
FIG. 4 shows an isometric drawing of a coin randomizer.

Attention is also directed to FIG. 4, and wherein an isometric drawing is shown of a housing 50 including obstruction pieces 18 and a slot 52 formed in one end to receive one or more coins 54. For this embodiment and although the coins 54 are conceivably removable, normally they are allowed to remain in the housing 50. Upon rotating the housing 50, different permutations of heads/tails are obtainable once the coins have randomly traversed the randomly positioned obstruction pieces 18.

Figure 5A:
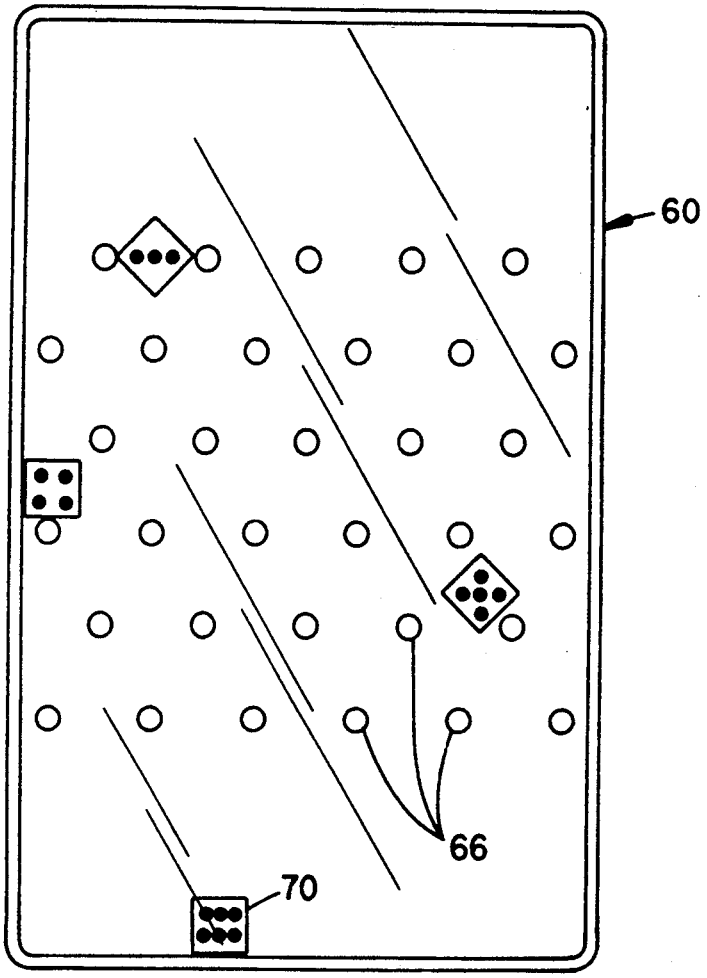
FIGS. 5*a*, 5*b* and 5*c* show respective front and side elevation drawings and a top plan drawing of a rectangular walled housing which is configured in two halves and includes a plurality of obstruction pieces which extend from the walls of the halves.
Figure 5B:
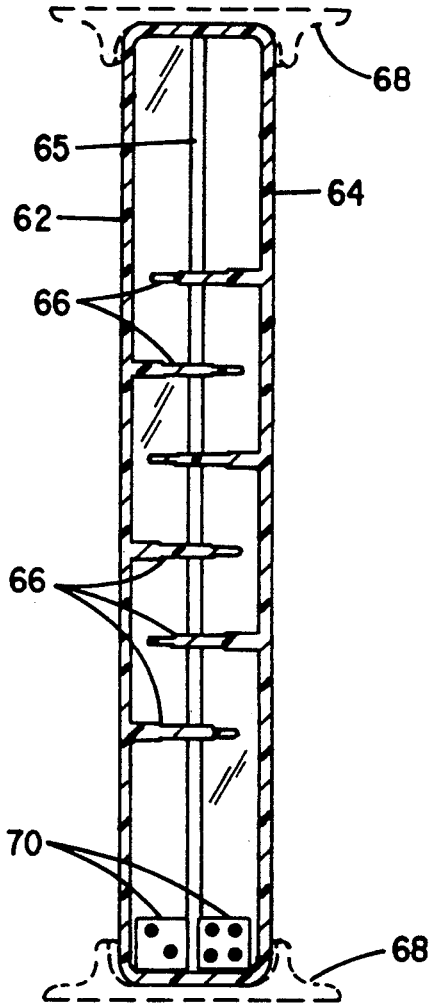
Figure 5C:
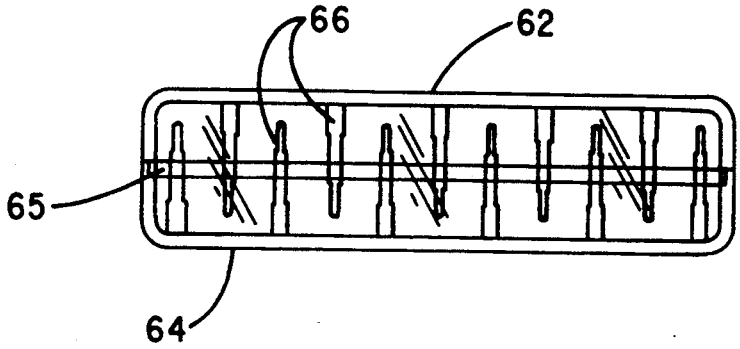

With attention to FIGS. 5*a*, 5*b* and 5*c*, respective front and side elevation drawings and a top plan drawing are shown of a rectangular walled randomizer 60 which is configured from two halves 62 and 64. The halves 62, 64 mounted to each other along a seam 65. Each of the halves 62, 64 includes a plurality of obstruction pieces 66 which are integrally formed with and project from the walls of the halves 62, 64. Shown in dashed line are end caps 68 which retain the halves together and serve as support stands for the randomizer 60. Alternatively, the halves 62, 64 can be adhesively bonded to one another. Mounted within the randomizer 60 are a number of indicia containing dice 70.

Figure 6:
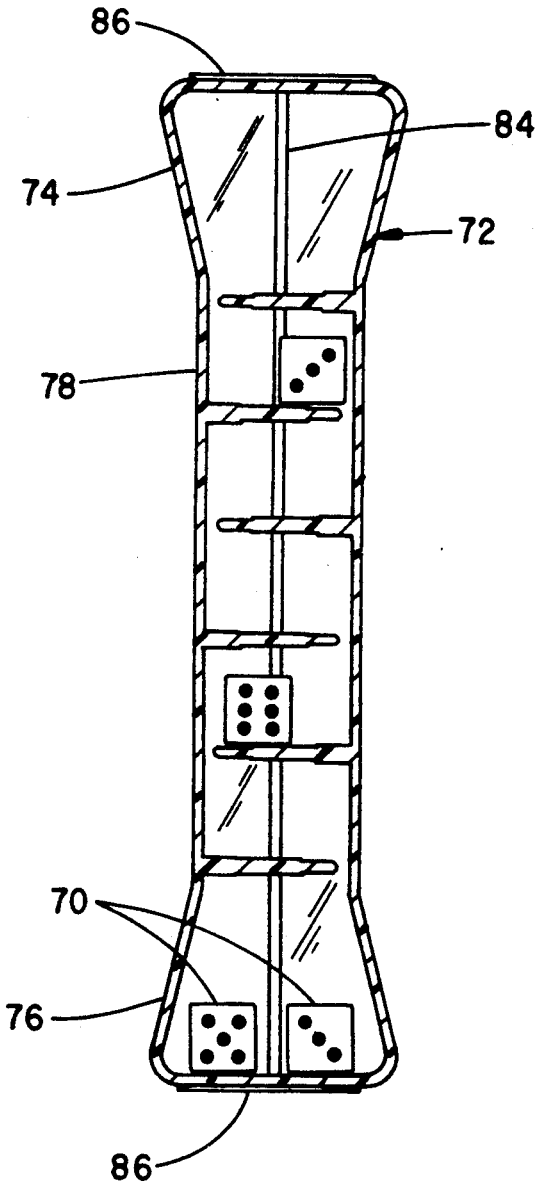
FIG. 6 is a side elevation drawing of a housing similar to that of FIGS. 5*a*, 5*b* and 5*c* wherein the ends are broadened to serve as support stands.

FIG. 6 depicts a randomizer 72 which is configured substantially similar to the randomizer 60, except the top and bottom ends 74 and 76 of the housing 78 are expanded to serve as table supports. The halves 80 and 82 of the housing 78 mount to one another along a seam 84 end, snap-lock retainers 86 which secure the halves 82, 84 to contain the dice 70. The obstruction pieces 14 extend in rows and are alternately, laterally offset from row to row to provide multiple pathways to the fall of the dice 70.

Figure 7:
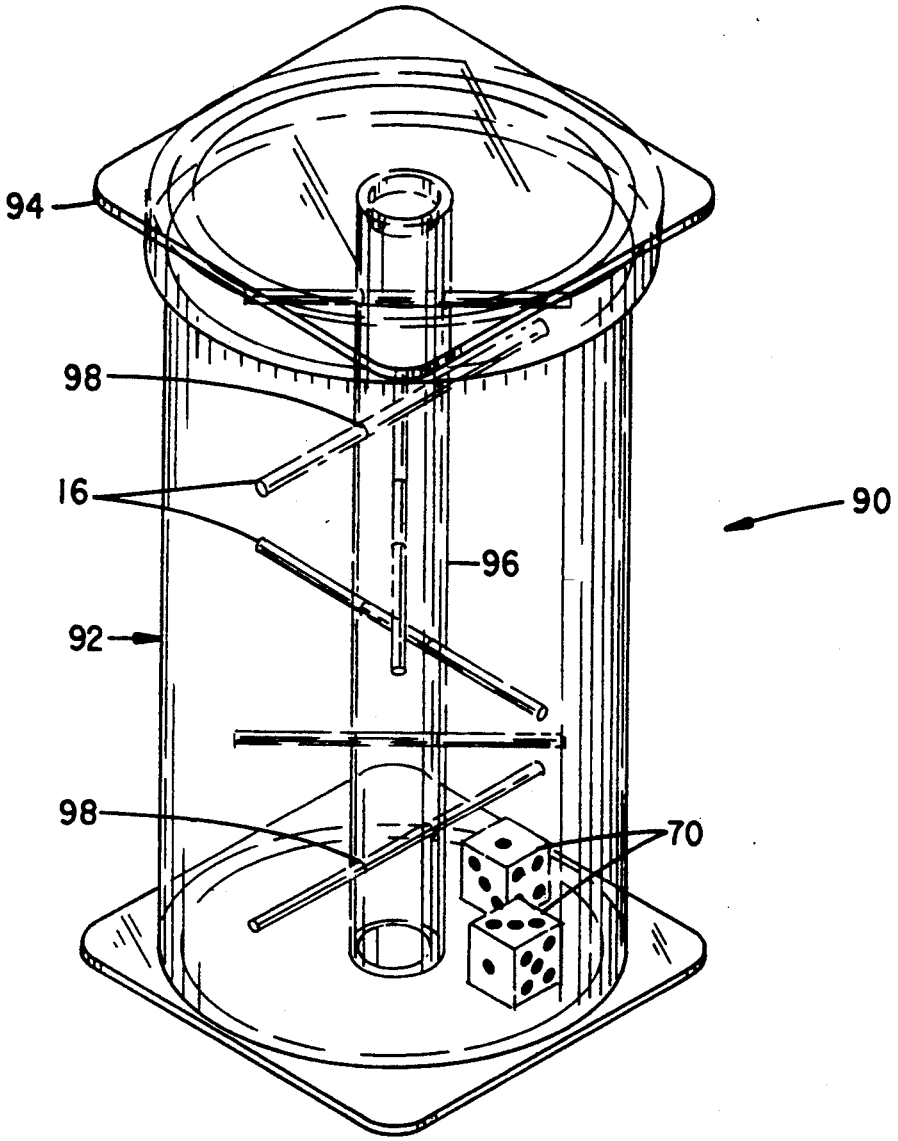
FIG. 7 is a perspective drawing of a randomizer having a removeable end cap and core which contains obstruction pieces.
Figure 8:
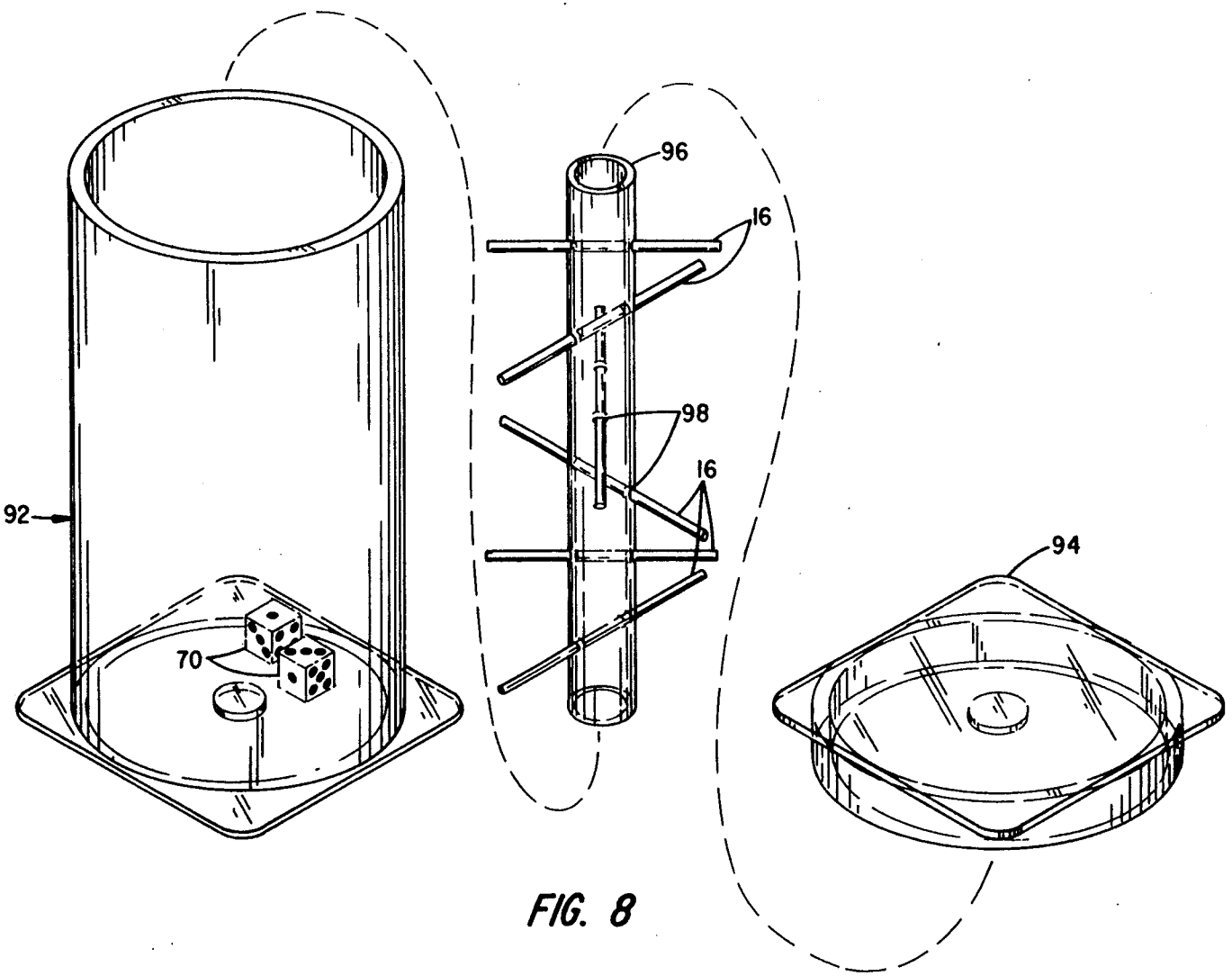
FIG. 8 is an exploded assembly drawing of FIG. 7.

FIGS. 7 and 8 disclose yet another randomizer 90 which is constructed to provide a housing 92 having a removable end cap 94. Contained within the housing 92 between the interior surfaces of the end cap 94 and the bottom is a core 96 which contains a plurality of obstruction pieces 16 mounted within apertures 98 let into the core 96. It is to be appreciated that other obstruction pieces 14 could also be mounted to extend from the outer periphery into the interior of the housing 92 in the fashion of the assemblies 2 and 10. A randomly defined free fall column is thereby presented to the contained dice 70 or other gamepieces.

Figure 9:
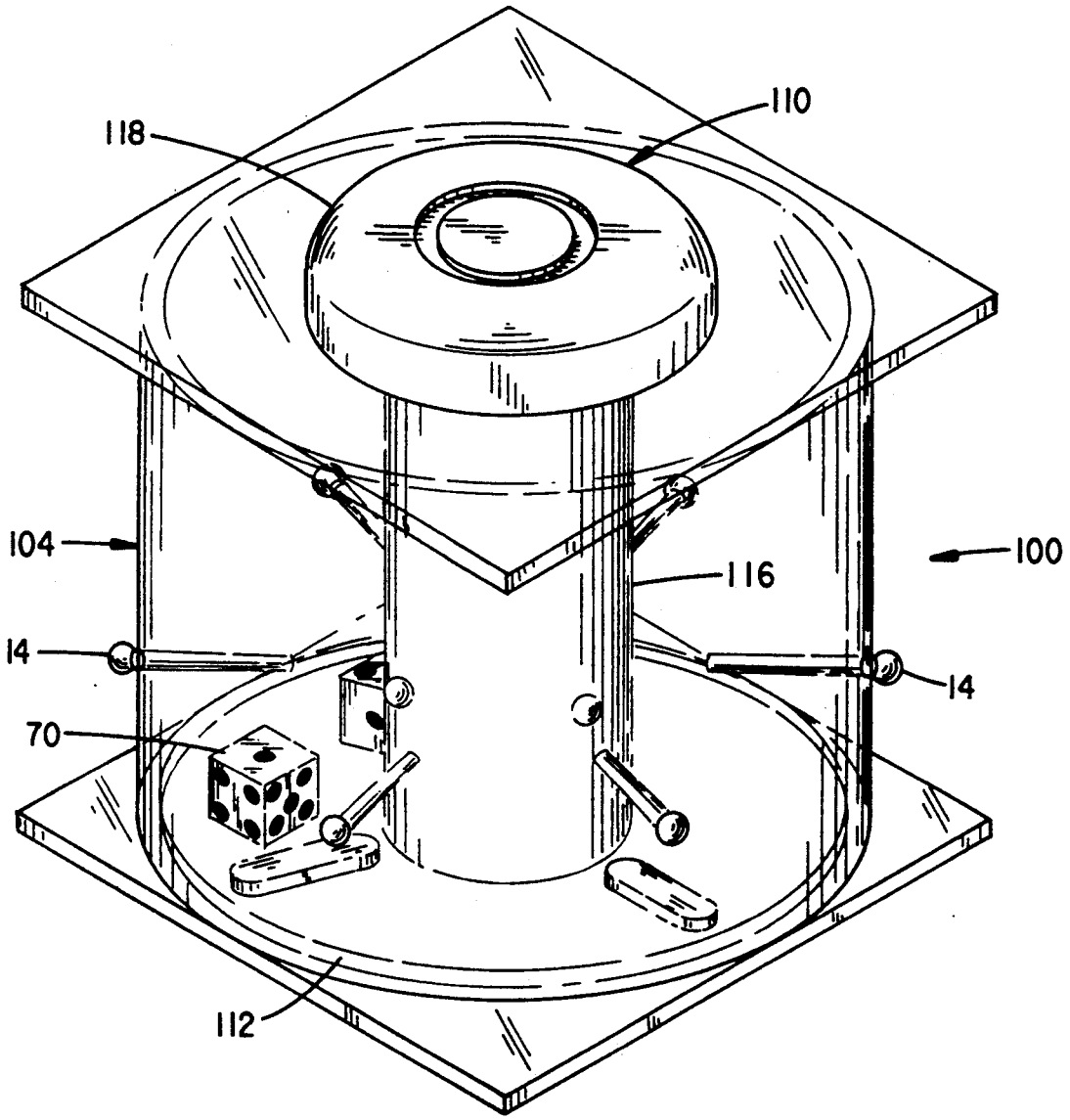
FIG. 9 is a perspective drawing of a randomizer containing a hand rotated actuator for inducing game piece movement relative to the obstruction pieces.
Figure 10:
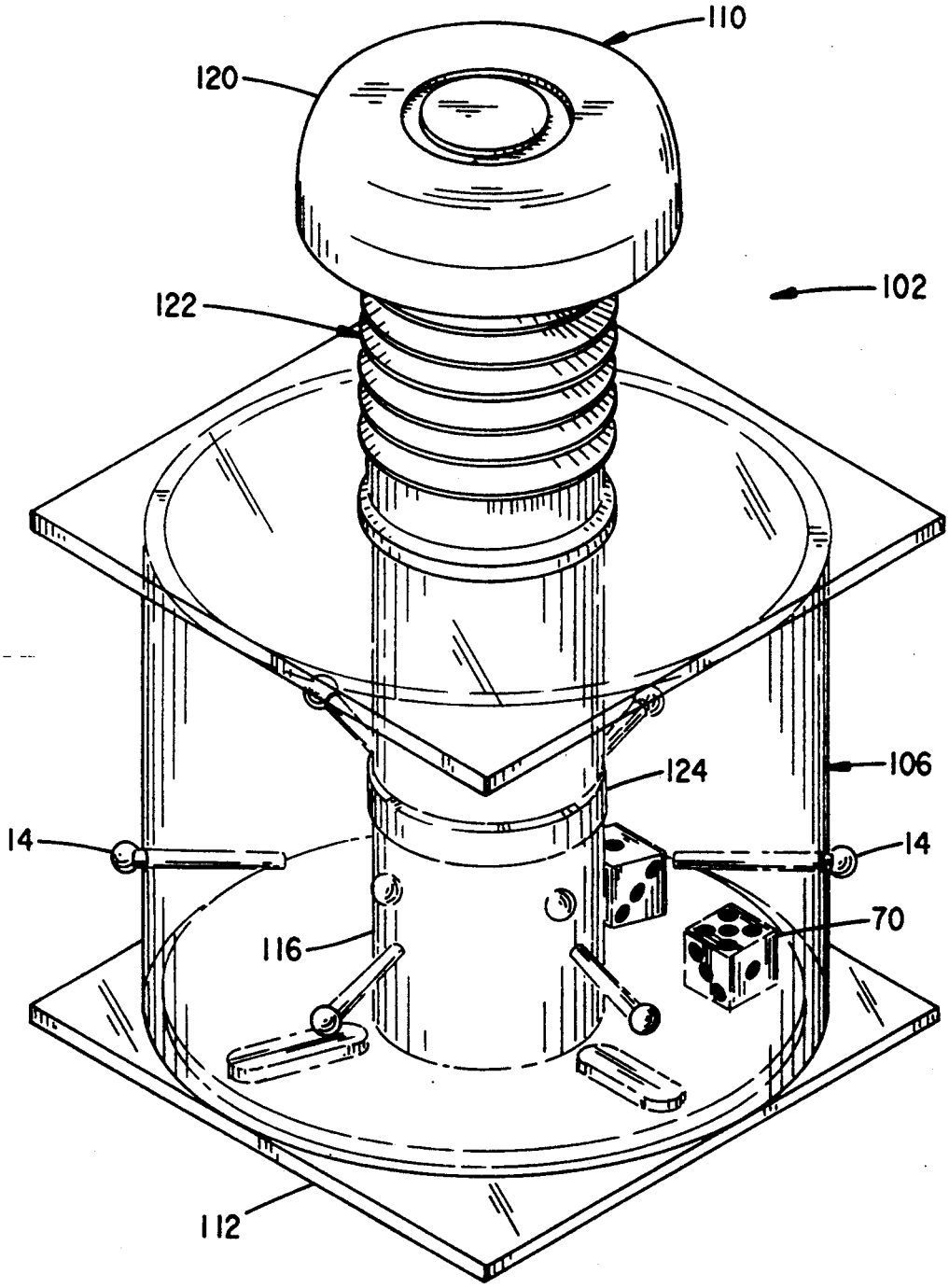
FIG. 10 is a perspective drawing of a randomizer containing a spring biased actuator.

FIGS. 9 and 10 disclose still other randomizers 100 and 102 which respectively provide housings 104 and 106 which support player mounted obstruction pieces 14. Although obstruction partially extending pieces 18 are particularly shown, the pieces can also comprise full extension pieces 16. Multiple dice 70 are supported within the housings 104 and 106 at game piece actuators 108 and 110. Each actuator 108, 110 contains a wheel or disc 112 which supports a plurality of radially disposed projections 114. The wheel 112 is mounted to pivot about a spindle (not shown). An axle 116 projects from the wheel 112.

For the randomizer 100 the axle 116 extends through the end wall to mate with a hand cap 118 which lends itself to rotation by the player. The player is able to spin the cap 118 and thereby the rotate wheel 112 to induce movement of the game pieces 70, which are engaged by the projections 114, to strike the obstruction pieces 14. A free fall column of sorts is thus obtained which depends only upon the duration the spinning is maintained.

Rotation of the wheel 112 at the randomizer 102 is obtained with a hand cap 120. The cap 120 includes a spring clutch portion 122 which couples to an axle portion 124 that mates with the axle 116. Upon depression of the cap 120, an internal coupler connection (not shown) induces rotation of the axle 116, wheel 112 and consequent movement of the dice 70.

While the present invention has been described with respect to various presently considered and preferred constructions, it is to be appreciated that still other constructions may suggest themselves to those of skill in the art. These, again, may constitute assemblies with permanently configured game piece pathways or assemblies having obstruction piece containing pathways under partial or complete player control, depending upon the rules of play. Accordingly, it is contemplated that the following claims should be interpreted to include all those equivalent embodiments within the spirit and scope thereof.

What is claimed is:

1. Game apparatus comprising:

a) a game piece having a plurality of surfaces and each surface containing a scoring indicia;

b) an enclosed housing includes a plurality of side walls which extend between first and second end walls to defined a free fall column between the first and second end walls whereat movement of said game piece is confined and wherein said plurality of side walls contain a plurality of apertures distributed over the length of said free fall column;

c) a plurality of obstruction members shaped to deflect said game piece upon contact and selectively mountable through ones of said apertures into and over the length of the free fall column to define a plurality of alternative pathways to said game piece at interstices between the obstruction members, and wherein the apertures are arranged such that none of the obstruction members can be individually posited to permanently obstruct movement of said game piece through the column whereby as the game piece traverses the free fall column the game piece randomly deflects from said obstruction members to follow one of the alternative pathways prior to coming to rest on one of the first and second end walls and displaying one of the scoring indicia.

2. Apparatus as set forth in claim 1 wherein ones of the obstruction members are mounted between pairs of apertures at ones of said walls and others of said obstruction members are mounted to partially project into the free fall column, yet prevent movement of the game piece between a distal end of the obstruction member and an adjacent wall of said housing.

3. Apparatus as set forth in claim 1 including an aperture through one of said walls for selectively admitting said game piece to said housing and wherein the aperture is positioned to prevent the escape of the game piece during normal play.

4. Apparatus as set forth in claim 1 wherein a plurality of obstruction members in a predetermined geometric pattern.

5. Game apparatus comprising:

a) at least one game piece having a plurality of surfaces and each surface containing a scoring indicia;

b) a multi-walled housing wherein the walls are arranged to define a free fall column whereat movement of said game piece is confined and including an aperture through one of the walls to selectively admit said game piece to said housing and positioned to prevent the escape of the game piece during normal play; and c) a plurality of obstruction members projecting into said free fall column from said walls and distributed over the length of said free fall column, wherein each obstruction member is shaped to deflect said game piece, and wherein none of the obstruction members contact any other obstruction member or wall, to form a plurality of random pathways to said game piece at the interstices between the obstruction members and without permitting passage of said game piece between the distal end of an obstruction member and an opposite facing wall, whereby as the game piece traverses the free fall column the game piece randomly deflects from said obstruction members to follow one of the pathways prior to coming to rest and displaying one of the scoring indicia.

6. Apparatus as set forth in claim 5 wherein said housing includes a plurality of apertures extending through the walls and in communication with the free fall column for selectively supporting player insertable obstruction members within the free fall column.

7. Game apparatus comprising:

a) a game piece;

b) a multi-walled housing including an entrance aperture whereat said game piece is admitted to play, a bottom tray, a free fall column defined by a plurality of walls extending between the entrance aperture and bottom tray and containing a plurality of apertures through the walls and distributed over the length of the free fall column;

c) a plurality of obstruction members shaped to deflect said game piece upon contact and selectively mountable through ones of said apertures into and over the length of the free fall column to define a plurality of alternative pathways at the interstices between the obstruction members, wherein the apertures are arranged such that none of the obstruction members can be individually positioned to permanently obstruct movement of said game piece through the column, wherein ones of said apertures are arranged over a first portion of said column to define a predetermined geometrical pattern and others of said apertures are arranged over a second portion to define a random pattern, whereby said game piece upon traversing the free fall column deflects from ones of said obstruction members to randomly follow one of the pathways; and d) means at said tray for randomly directing said game piece to one of a plurality of partitioned tray compartments, wherein each compartment is assigned a unique scoring value for any entering game piece.

8. Apparatus as set forth in claim 7 wherein the apertures of the first portion are arranged to define at least one helical arrangement of said obstruction members centered along a longitudinal center axis of the free fall column.

9. Apparatus as set forth in claim 7 wherein the tray directing means comprises a plurality of possible exit apertures to said game piece from said housing, wherein each aperture is aligned with at least one of the tray compartments.

10. A method for playing a game comprising:

a) selectively positioning a plurality of members through a plurality of apertures in a plurality of walls of an enclosure to define a plurality of alternative pathways at interstices between said members, wherein each member is shaped to deflect and not restrict movement of a game piece, wherein said apertures are distributed over the length of a free fall column defined by the walls, and wherein ones of said members are supported between pairs of said apertures and others of said members partially project into the free fall column; and b) admitting a game piece to the free fall column upstream of the positioned members, whereby as the game piece traverses the free fall column the game piece randomly deflects from said members to randomly follow one of the pathways prior to coming to rest at an end wall of the enclosure.

11. A method as set forth in claim 10 including the step of randomly directly the game piece upon traversal of the free fall column to one of a plurality of compartments, wherein each compartment has a unique scoring value.

* * * * *